US005377751A

United States Patent [19]

Uherek et al.

[11] Patent Number: 5,377,751

[45] Date of Patent: Jan. 3, 1995

[54] APPARATUS AND METHOD FOR CENTRALIZING DOWNHOLE PIPE AND BLAST JOINTS

[75] Inventors: Robert J. Uherek, Stuart, Fla.; Brian Uherek; George A. Moran, both of Houston, Tex.

[73] Assignee: Rickert Precision Industries, Plymouth, Mich.

[21] Appl. No.: 827,622

[22] Filed: Jan. 29, 1992

[51] Int. Cl.[6] ..... E21B 17/10

[52] U.S. Cl. ..... 166/241.6

[58] Field of Search ..... 166/241.4, 241.6, 243, 166/241.1, 241.3, 117.5, 381; 175/325

[56] References Cited

U.S. PATENT DOCUMENTS

| | | | |
|---|---|---|---|
| 2,176,766 | 10/1939 | Johnston | 166/1 |
| 2,659,439 | 11/1953 | Baker | 166/241.6 |
| 2,739,654 | 3/1956 | Kinley et al. | 166/178 |
| 2,812,717 | 11/1957 | Brown | 103/52 |
| 2,907,351 | 10/1959 | Rohrback et al. | 138/25 |
| 2,925,097 | 2/1960 | Duesterberg | 138/64 |
| 3,001,834 | 9/1961 | Bowerman | 166/241.4 |
| 3,034,912 | 5/1962 | Flowers | 166/243 |
| 3,292,708 | 12/1966 | Mundt | 166/241.6 |
| 3,365,000 | 1/1968 | Arnwine | 166/243 |
| 3,382,930 | 5/1968 | Ribb et al. | 166/242 |
| 3,933,203 | 6/1976 | Evans | 166/241.6 |
| 3,963,075 | 6/1976 | Evans | 166/241.6 |
| 3,995,665 | 12/1976 | Monagham | 138/147 |
| 4,028,796 | 6/1977 | Bergstrom | 29/416 |
| 4,141,386 | 2/1979 | Bergstrom | 138/147 |
| 4,211,440 | 7/1980 | Bergstrom | 286/46 |
| 4,349,050 | 9/1982 | Berstrom et al. | 138/147 |
| 4,381,821 | 5/1983 | Greene, Jr. | 166/243 |
| 4,613,165 | 9/1986 | Kuhne | 285/45 |
| 4,635,968 | 1/1987 | Kuhne | 285/45 |
| 4,685,518 | 8/1987 | Claycomb | 166/243 |
| 4,726,423 | 2/1988 | Claycomb | 166/380 |
| 4,889,185 | 12/1989 | Uherek | 166/243 |
| 4,911,479 | 3/1990 | Claycomb | 285/39 |
| 4,915,177 | 4/1990 | Claycomb | 166/380 |
| 5,016,921 | 5/1991 | Claycomb | 285/39 |
| 5,069,284 | 12/1991 | Gray | 166/241.4 |

OTHER PUBLICATIONS

Blast Joints Inc. information sheet describing their carbide blast joint.

Smith International information sheet describing their downhole remedial tools.

*Primary Examiner*—Michael Powell Buiz
*Assistant Examiner*—Frank S. Tsay
*Attorney, Agent, or Firm*—Matthews & Associates

[57] ABSTRACT

The present invention utilizes a centralizer having a plurality of segmented stress risers. The segmented stress risers are designed to allow sufficient strength to maintain the tubing in a centralized downhole location, while to allow for the stress relief grooves to be sheared off when a wash pipe or similar device is utilized to clean out any unwanted build up of material or deposits in the borehole. Once the segments have been sheared off they can be circulated out of borehole.

9 Claims, 9 Drawing Sheets

APPARATUS AND METHOD FOR CENTRALIZING DOWNHOLE PIPE AND BLAST JOINTS

BACKGROUND OF THE INVENTION

1. Field of the Invention

The present invention is directed to a centralizer for the use of maintaining downhole production tubing or the like in a centralized position within the casing and/or hole. The present invention is more specifically designed for use in a blast joint configuration in order to prohibit the blast joint from settling against the casing or any particular side of the hole.

The apparatus of the present invention can be used separate and apart from a blast joint with appropriate retaining ends to prevent slipping. The centralizer would normally be placed over the production tubing of a hydrocarbon well in order to prevent the tubing from settling on one side or the other of the casing. Often wells are drilled in a directional or deviated (non-vertical) manner as opposed to directly vertical and perpendicular to the horizon. In these situations, it has become a concern that the tubing and/or blast joint will rest on the lower end of the casing or at least off center. In light of that concern, the present invention has been developed.

Blast joints are commonly used when an oil or gas well has been drilled which encounters two or more producing formations or zones. In such a situation, each producing formation is produced through a separate string of production tubing extending into the well bore. Typically, a string of production tubing extends to the lowermost producing formation. A packer is set about the production tubing string between the producing formations to isolate the upper producing formation from the lower producing formation. A second string of production tubing extends into the well bore to the upper producing formation. A packer is set above the upper producing formation to close off the annulus about the two strings of production tubing so that the upper production zone is isolated between the two packers. Thus, each string of production tubing is in fluid communication with the production formation adjacent the lower open end of the production tubing. This is commonly referred to as a dual completion well.

Downhole well equipment is exposed to erosive elements in the well bore. This is particularly true in a dual completion well where one string of production tubing extends through an upper producing zone. Flow into the well bore in the upper producing zone, particularly in formations producing high pressure gas, is at high velocities. Abrasive materials, such as unconsolidated sand grains, are often entrained in the fluid stream and impinge on the production tubing. This action is extremely abrasive and erodes the pipe surface, thus requiring replacement of the production tubing. This is a very time consuming process which may be repeated often, particularly of wells having high sand content. Blast joints have been designed and developed in order to protect the tubing.

Many of the blast joints which were used to protect the production tubing utilized tungsten carbide elements. Tungsten carbide is a particularly heavy metal. Even though settling of the production tubing can be a concern without a blast joint, or when a blast joint is utilized which does not include tungsten carbide, the addition of tungsten carbide can cause an even greater concern due to the additional weight which is placed on the tubing.

In a downhole well, particularly when erosive elements are present which require the use of a blast joint, sand and dirt can accumulate around the production tubing and the blast joint if one has been placed on the tubing. Often and dirt cannot be circulated out of the hole because of the sheer amount of the buildup. Eventually, the buildup can become so great the pipe cannot be moved within the casing resulting in stuck pipe. This can be the result of differential wall sticking, the existence of too much sand, dirt and material within a particular confined space, or other similar and related phenomenon.

Normally, in order to alleviate the situation, a wash pipe is run down into the casing to remove the unwanted and undesirable excess dirt, sand and the like. However, if the pipe or blast joint has become so heavy or so off centered, it may be impossible to run the wash pipe through the length of the area which contains the undesirable materials. This is normally due because the pipe or blast joints become stuck or so heavily weighted against one side of the casing, there is simply not enough room for the wash pipe to surround the entire pipe or blast joint in the area where the buildup of undesirable materials has occurred.

The problem with generally accepted and standard centralizers is twofold: they are not normally adapted to be used with a blast joint; and, they may not allow sufficient clearance to be surrounded by a wash pipe. The problem is exacerbated when a blast joint is used because the clearance between the tubing and the casing becomes even more narrow since the circumference of the tubing is surrounded by the protective material of the blast joint. The centralizer must then fit over that material so that the tubing remains protected but still centralized within the casing. In order to overcome this problem, the present invention utilizes a plurality of stress risers which are segmented. This can normally be accomplished by drilling a plurality of stress relief apertures between each vertically segmented portion of each stress relief riser. The segmentation is preferably designed so as to allow sufficient strength to maintain the tubing in a centralized location downhole, but to allow for the stress relief grooves to be sheared when a wash pipe or similar device is utilized to clean out any unwanted buildup of materials or deposits. Once these segments have been sheared off, they can be circulated out of the hole in most situations.

2. Description of the Related Art

U.S. Pat. No. 3,379,269 discloses a system for protecting the production tubing comprising a plurality of baffle sleeves concentrically mounted about the production tubing in the area of an upper producing formation. Each of the sleeves includes perforations which are staggered in relation to the perforations in the next adjacent sleeve so that the erosive fluid entering the well is forced to follow a tortious flow path before it impinges on the production tubing. The changing flow path causes the erosive fluid to decrease its kinetic energy and reduce its impact velocity before it reaches the production tubing, thereby reducing erosion of the tubing.

U.S. Pat. Nos. 4,141,368 and 4,028,796 to Bergstrom disclose a blast joint comprising a series of short cylindrical rings composed of cemented tungsten carbide and the method of producing a blast joint for oil well production tubing. The rings are disposed coaxially in contact with each other between end retaining rings mounted upon a supporting steel tube which comprises a single section or joined sections of production tubing.

In U.S. Pat. No. 4,211,440, Bergstrom suggests that the successful functioning of the blast joint in a well is dependent upon the handling of the blast joint before it is positioned in the well. To this end, Bergstrom discloses the introduction of a yieldable compression spring encircling the production tubing and disposed between the end of the carbide rings and the ring retaining clamp to allow any freedom of movement of the rings relative to the tubing to permit handling and moving of the assembled blast joint without damage to the carbide rings.

U.S. Pat. No. 4,349,050, also to Bergstrom, merely discloses a particular type of end retainer which can be used in conjunction with the blast joints described in the other Bergstrom patents. This patent also discloses and claims certain types of protective coatings for the elements which make up the end retainers.

U.S. Pat. Nos. 4,613,165 and 4,635,968 to Kuhne disclose a multi-joint blast joint. The blast joint of Kuhne is formed by suspending a tubular member having a plurality of rings mounted thereon in the well bore. Pipe slips are used to suspend the tubular member in the well bore. Pipe slips engage the tubular member about an area not covered by the protective rings. A subsequent tubular member is coupled to the tubular member suspended in the well bore and the protective rings are thereafter lowered to enclose the coupling connection.

U.S. Pat. Nos. 4,685,518 and 4,726,423 which are patents assigned to the same assignee as this invention, and which disclosures are incorporated by reference herein, disclose a blast joint which can be easily utilized on downhole tubing which utilizes full strength upset couplings of the tubing joints. This is accomplished by the use of a ring assembly supported in telescoping relation about the erosion resistent rings on one joint said ring assembly being moveable between a first and second position wherein said ring assembly encloses the point of connection between the joints of tubing upon shifting the ring assembly to its second position.

U.S. Pat. No. 4,889,185 discloses a multi-joint blast joint comprising a series of standard length joints production tubing which includes a slip sleeve mounted about the blast joint providing a pipe slip engaging surface for suspending the blast joint in the well bore. Other prior art blast joints include those disclosed in U.S. Pat. Nos. 2,925,097 and 3,365,000 to Duesterberg and Arnwine, respectively.

The present invention is generally designed so as to allow for use with virtually any blast joint where possible.

SUMMARY OF THE INVENTION

The invention of the present disclosure is directed to an improved apparatus and method for centralizing oil well production tubing as well as blast joints which might protect such tubing. The centralizer of this invention includes a single cylindrical unit with a plurality of stress risers. The centralizer is mounted about the production tubing and/or the blast joint within the cylindrical casing of the downhole well. The stress risers maintain the tubing and/or blast joint within the general central area of the casing. The stress risers are designed so as to allow their removal when necessary to remove undesirable debris or sediment which might have accumulated about the circumference of the tubing or blast joint. The shearing is normally accomplished when a wash pipe is run downhole within the casing, but outside of the production tubing and/or blast joint which will then shear off the stress risers and allow for continued lowering into the hole past the point the centralizer is located.

BRIEF DESCRIPTION OF THE DRAWINGS

The appended drawings are provided in order to illustrate only the typical and/or preferred embodiments of this invention. These drawings should not be considered limitations of the scope of this invention for it may encompass other effective embodiments.

DETAILED DESCRIPTION OF THE PREFERRED EMBODIMENT

Figure 1:
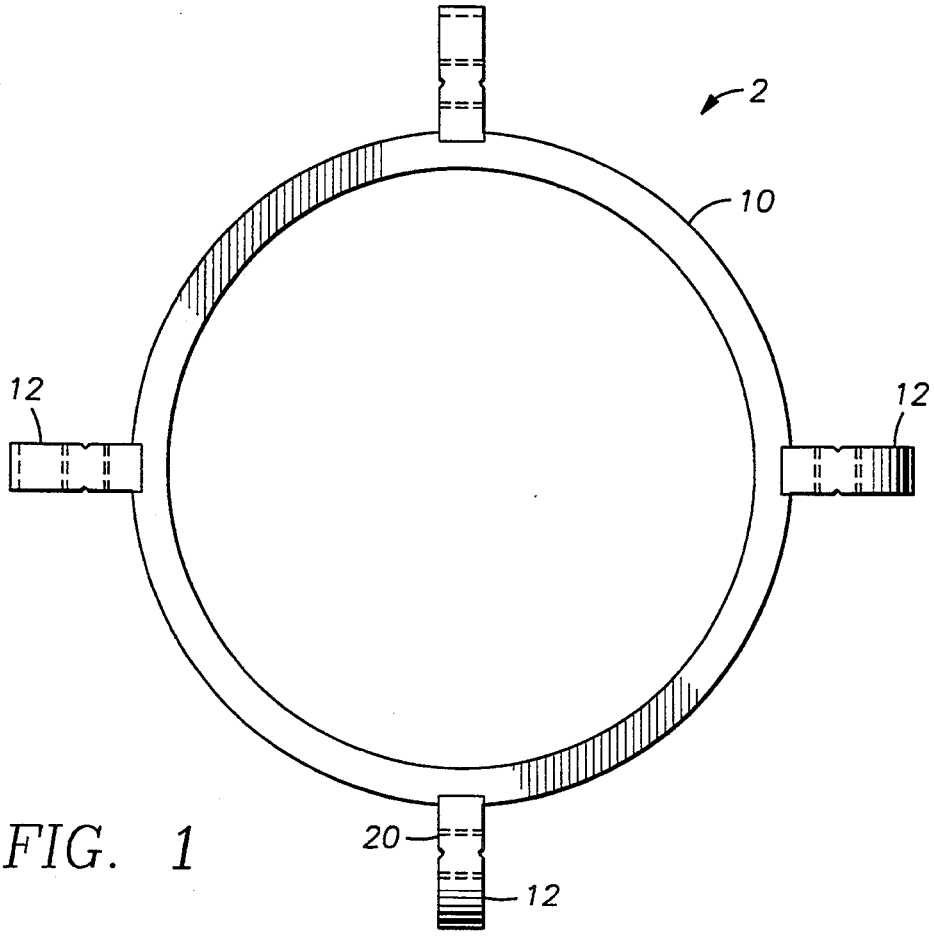
FIG. 1 is an overhead view of the centralizer of the present invention.
Figure 2:
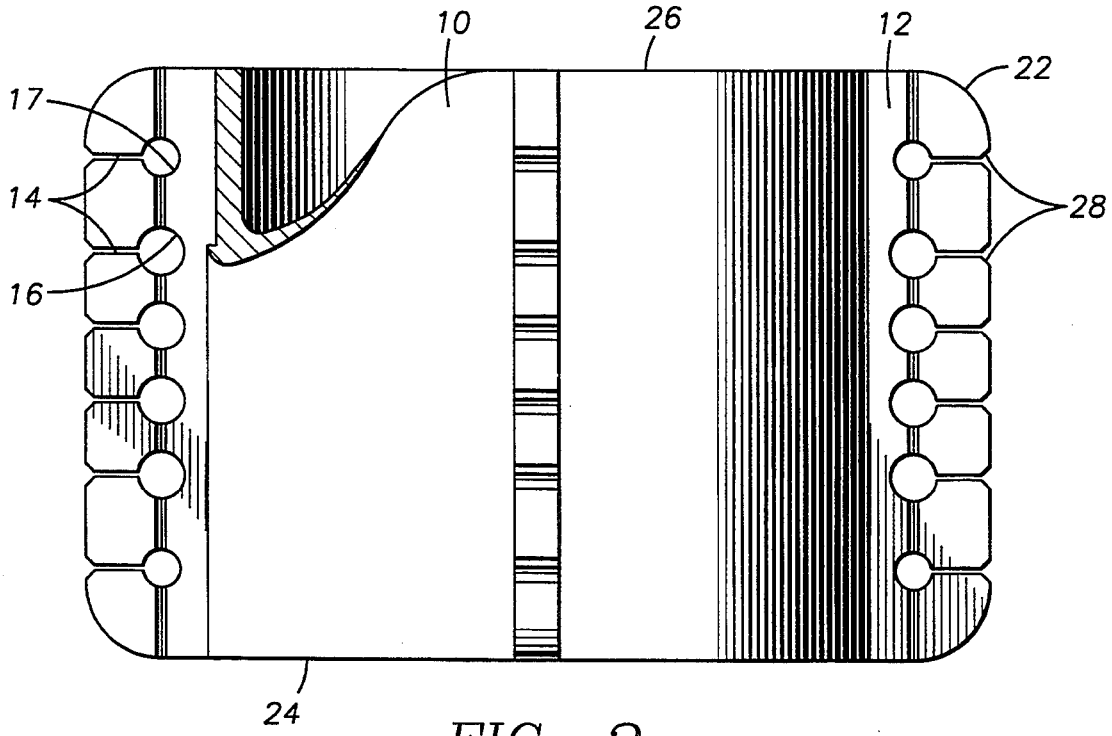
FIG. 2 is a partially cut away side view of the centralizer of the present invention.

Shown in FIGS. 1 and 2, the present invention 2 incorporates a cylindrical body 10 open at either end with a plurality of outwardly extending stress risers 12. The stress risers are segmented by virtue of vertical spaces 14 and stress relief apertures 16 and 17. These vertical spaces 14 and stress relief apertures 16 and 17 are preferably dimensioned so as to allow for a wash pipe, rotary shoe or similar device to shear the segmented sections 18 of the stress risers 12 thereby separating them from the body 10 of the present invention.

The segmented sections 18 of the stress risers 12 are commonly attached to a base 20 which is in turn fixedly attached to the cylindrical body 10 of the present invention. The outward corners of the stress risers 22 are curved. Additionally, the corners of each segmented section 18 of the stress risers 12 are angled at the outside corner of each vertical space 14.

In one embodiment of the present invention, the outside stress relief apertures 17 are one quarter (¼) inch in diameter while the internal stress relief apertures 16 are five sixteenths (5/16) of an inch in diameter. Similarly, in a preferred embodiment of the present invention, the vertical spacing 14 between the segmented sections 18 of the present invention are 0.031 inches wide.

Again in a typical preferred embodiment, the stress risers extend 0.930 inches from the outside of the cylindrical base 10 and the bottom of the stress relief apertures 16 are 0.190 inches from the outside of the cylindrical body 10. Finally, in a typical preferred embodiment, the center of each stress relief aperture 14 can be located 0.6, 1.225, 1.725, 2.226, 2.725 and 3.350 inches, respectively, from either open end of the unitary body 10. The unitary body 10 itself in a typical preferred embodiment would be 3.950 inches at length L. It is also appropriate for each opposing outside corner 28 located at the outer edge of each vertical space 14 to be angled.

Figure 3:
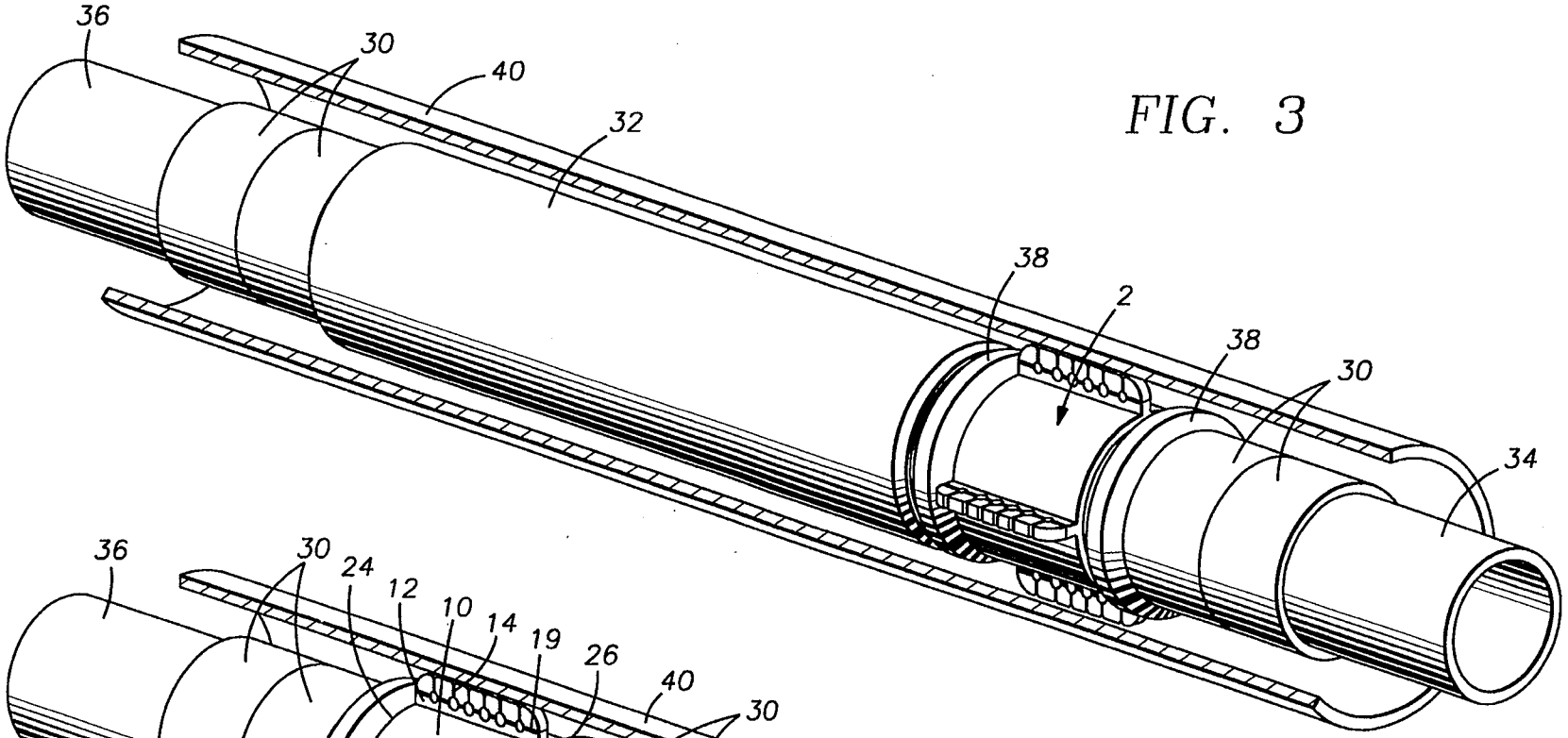
FIG. 3 is a prospective view of the centralizer of the present invention as utilized with a blast joint.
Figure 4:
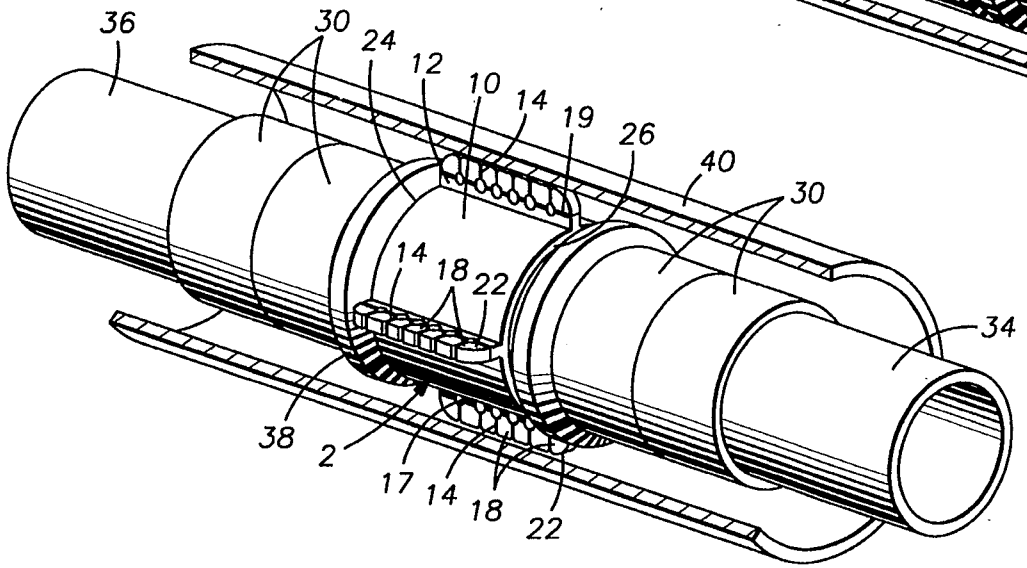
FIG. 4 is another prospective view of the centralizer of the present invention as utilized with a blast joint.
Figure 5:
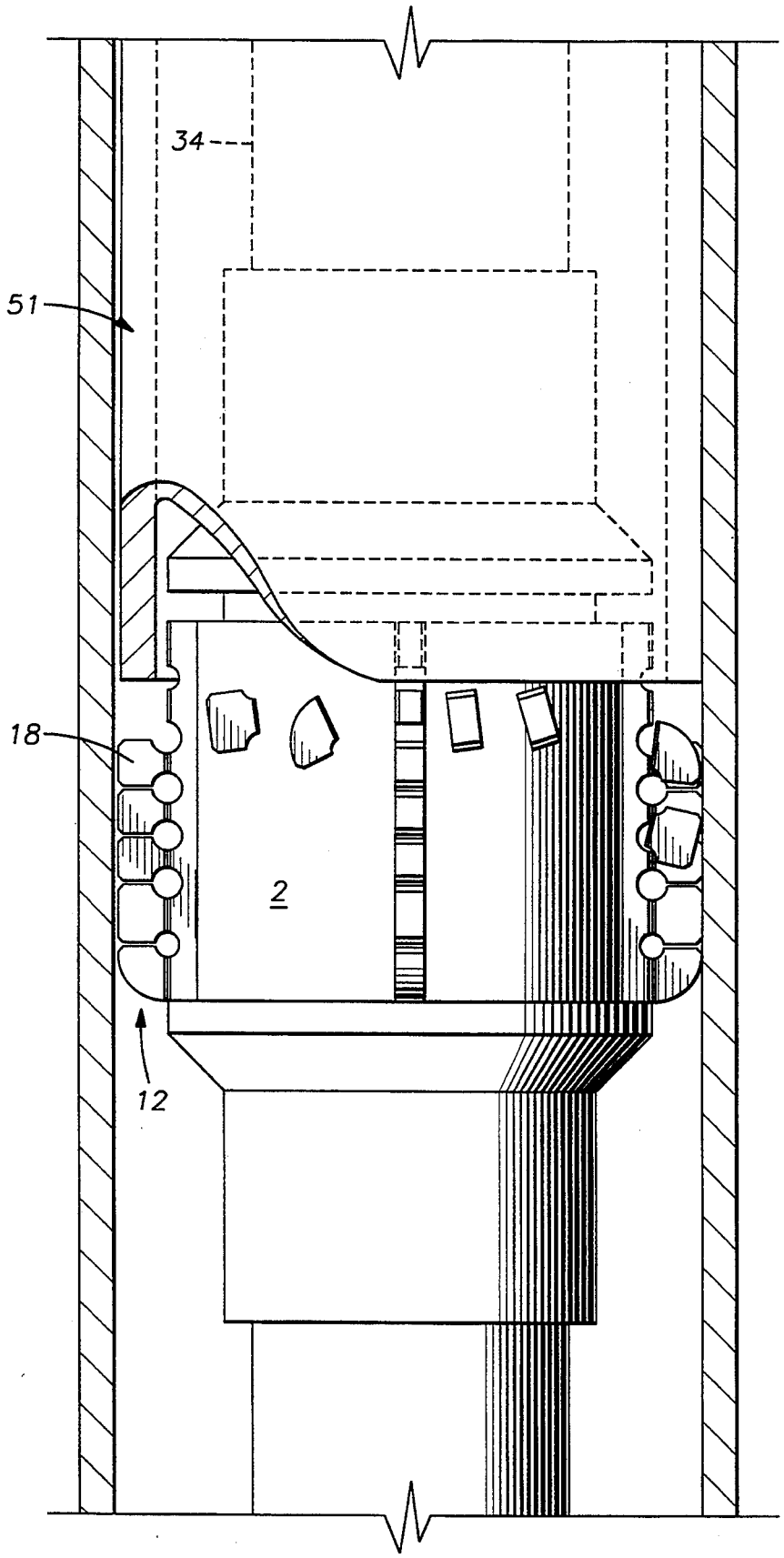
FIG. 5 is a prospective view of the present invention with separation of segmented portions of the centralizer of the present invention in progress.

In a typical use of the preferred embodiment, the centralizer might be placed along the production tubing as part of a blast joint as disclosed in FIGS. 3–5. Here, the present invention comprises a desirable additional part of the blast joint as shown. In FIG. 3, the blast joint is comprised of a number of erosion resistent rings 30 with a coupling shield 32 within which other rings are enclosed said other rings being of sufficient diameter to surround an upset coupling of two pipe joints 34 and 36. The centralizer 2 incorporates the features and elements described above and shown in FIGS. 1 and 2. The centralizer 2 is held in place by oversized erosion resistent rings 38 which are adjacent to either end of the centralizer 2 and prevent the centralizer from slipping up or down along the blast joint or tubing. Under the centralizer 2 are other erosion resistent rings which protect the tubing if any portion of the centralizer were to wear away. FIG. 3 discloses the present invention incorporated with a blast joint as utilized in a production well with the casing of said well identified as 40.

FIG. 4 discloses the present invention as utilized on a blast joint which does not extend beyond a single joint of tubing or alternatively one where the blast joint extends over two pieces of tubing which are connected by a flush joint. If a connection is not located within the blast joint of this figure, then the production tubing identified as 36 would actually be the same tubing as exposed on the opposing end 34. Again in this figure, the casing is identified as 40, the centralizer as 2, the tungsten carbide rings as 30, and the oversized rings as 38. The rings 30 will normally extend the length of the tubing under the centralizer 2 and extending outward on either end thereof.

The present invention can also be utilized where no blast joint has been installed. This will be preferably accomplished by utilizing some type of a locking assembly on both ends of the centralizer 2 to prevent movement up or down the production tubing 34. A locking assembly such as described in U.S. Pat. No. 4,685,518 and below would be appropriate to accomplish this purpose.

Figure 6:
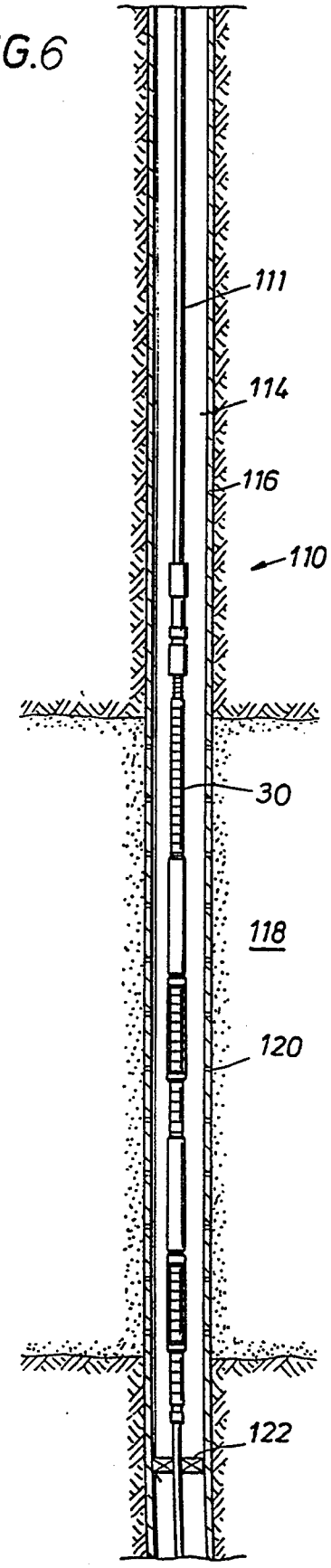
FIG. 6 is a side elevational view of a production string in a well bore showing a blast joint in the interval of a producing zone.

The general assembly of a blast joint is described in the patents identified above which have been assigned to Rickert Precision Industries. Referring first to FIG. 6, a blast joint to be used with the present invention is generally identified by the reference numeral 110. The blast joint 110 forms a part of a production tubing string 111 which extends in a well bore 114. The well bore 114 is defined by a casing string 116 traversing a producing formation 118. The casing 116 is provided with a plurality of perforations 120 which define an open production interval in the formation 118.

A packer 122 is disposed between the productive formation 118 and a lower productive formation (not shown in the drawings) in order to isolate these formations from one another so that there is no communication between these formations within the well. A production tubing string 111 is disposed in the well as illustrated and extends from the wellhead to below the packer 122 to the lower productive formation. Fluids from the lower productive formation thus are produced through the interior of the production tubing string 111 and carried to the surface of the well for delivery to a storage tank facility. Fluids produced from the productive formation 118 flow to the surface in the annular space between the production tubing string 111 and the casing 116. If desired, a second packer may be disposed above the productive formation 118 and a second tubing string provided in the well bore 114 and terminating adjacent the perforations 120 providing a production passage to the surface of fluids produced from the productive formation 118.

The production equipment thus far described is conventional. Also, it will be understood that the downhole arrangement thus far described is illustrative only and other suitable arrangements may be used. For example, the well bore 114 may be cased or uncased. Alternatively, the well bore 114 may be partially cased and partially uncased. Other well completion practices are also available and are well known to those skilled in the art.

In accordance with the present disclosure, there is disposed within the well bore 114 a production tubing 111 which is in fluid communication with a productive formation below the producing formation 118. The blast joint 110 forms a portion of the production tubing 111 and is disposed in the well bore opposite the producing interval of the productive formation 118 defined by the perforations 120. The blast joint 110 is a protective sheath or shield of erosion resistent material which encloses a portion of the production tubing 111 to protect it from the erosive action of the high velocity fluid and entrailed particles entering the well bore 114 through the perforations 120. The erosion resistant material forming the blast joint of the present disclosure may be made of any suitable material exhibiting erosion resistant properties. In the preferred embodiment, however, described in greater detail hereinafter, the erosion resistant material is tungsten carbide formed in rings which are stacked end to end and carried on the tubular members forming the blast joint 110 between end located retention clamps. Ceramic is also a suitable erosion resistent material which may be used to form the blast joint of the present disclosure.

Figure 7A:
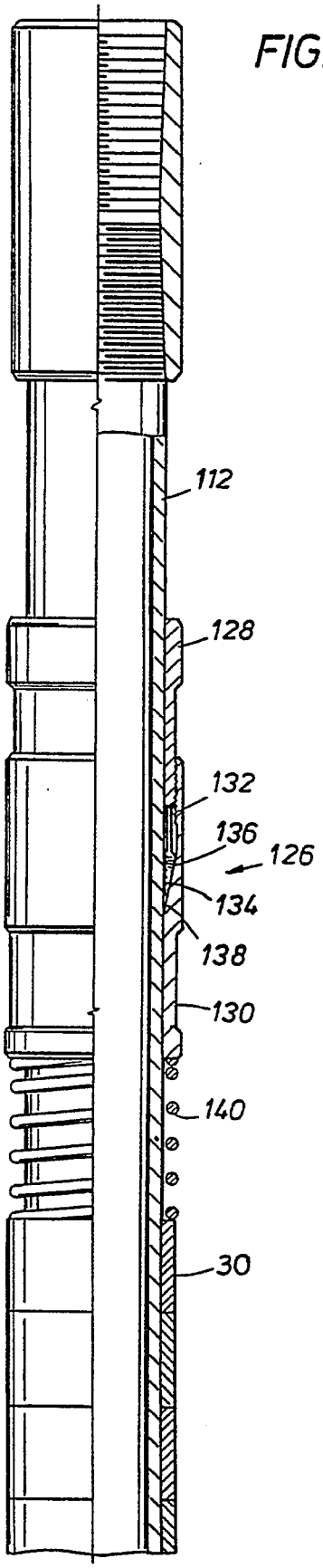
FIGS. 7A–C are partial vertical longitudinal sectional views of a blast joint as described herein.
Figure 7B:
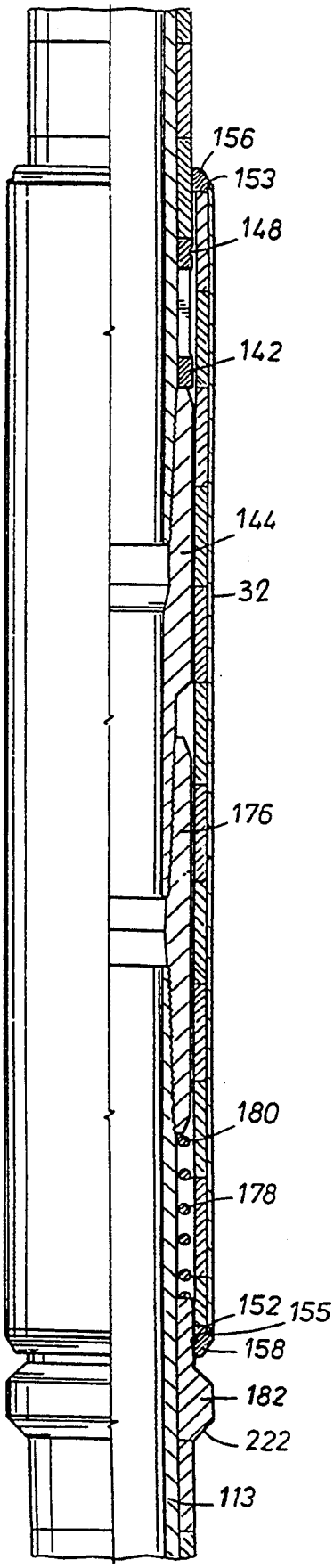
Figure 7C:
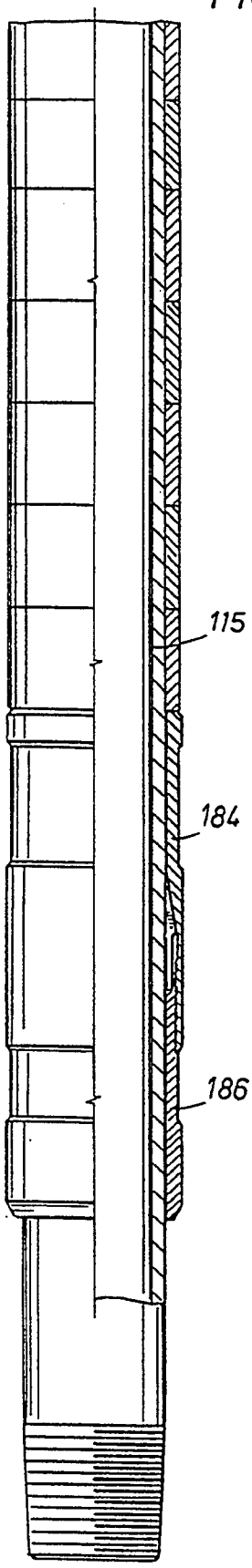

Referring now to FIGS. 7A through 7C, the blast joint 110 of the present invention will be described from top to bottom. The blast joint of the present disclosure shown in FIGS. 7A through 7C comprises several tubular members joined end to end in a manner to be described. for example, the blast joint 110 of the present disclosure may comprise one or more joints of production tubing joined together and enclosed by an erosion resistant protective assembly of erosion resistant rings 124. The blast joint 110 is incorporated in the production tubing string 111 disposed within the well bore 114 as shown in FIG. 6.

The upper portion of the blast joint 110 comprises a plurality of rings 124 assembled on a tubing member 112 in end face to face contact and are held in compression between end located locking assemblies 126. At the upper end of the blast joint 110, the locking assembly 126 comprises a slip ring 128 and a bowl ring 130 threadedly engaged about the tubing 112. Initially, the locking assembly 126 is slipped over the pin end of the tubing 112 and clamped thereon at a desired location. The slip ring 128 includes a plurality of flexible fingers 32 extending from a threaded portion thereof. The fingers 32 are provided with a serrated surface 136 which coacts with an oppositely tapered surface 138 formed on the internal body of the bowl ring 30 to compress the fingers 132 in locking engagement with the tubing 112.

After the locking ring assembly 126 is clamped to the tubing 112, a spring 140 and a plurality of carbide rings 30 are slid over the pin end of the tubing 112. The carbide rings 124 fit snugly on the tubing 112 and abut against the spring 140. The number of carbide rings 30 mounted on the tubing 112 may vary depending upon the axial length of each ring; however, a sufficient number of carbide rings 30 are used to totally encase the tubing 112 from the spring 140 to a support sleeve 142 located adjacent the pin end of the tubing 112. An internally threaded connector 144, commonly referred to as a cross over sub, is threaded on the pin end of the tubing 112 in abutting engagement with the support sleeve 142 providing a lower stop shoulder for the stack of carbide rings 130. Thus, the carbide rings 130 are compressed between the spring 140 and the support sleeve 142 and maintained in end face to face contact providing a protective shield for the tubing 112.

Figure 8:
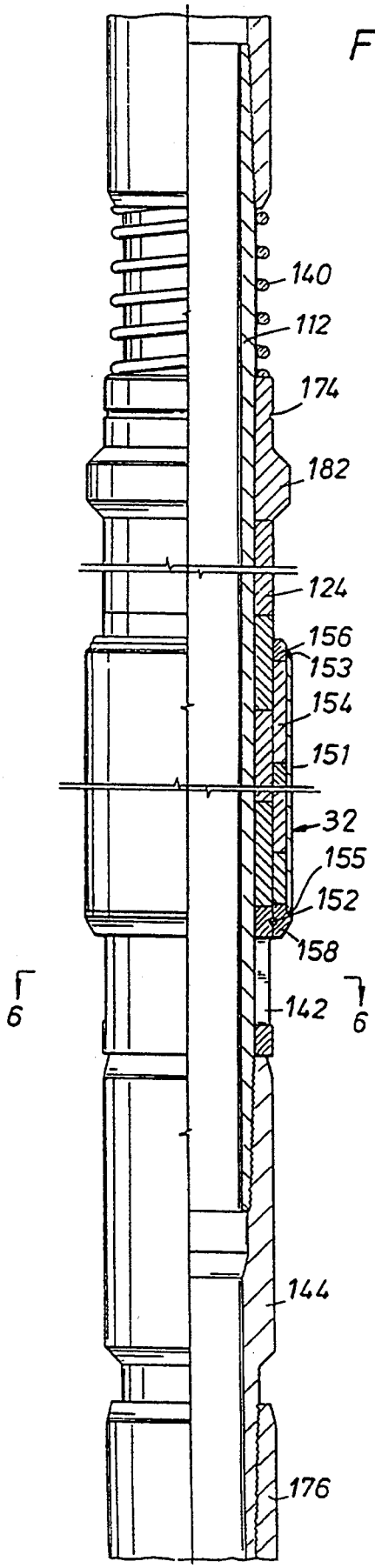
FIG. 8 is a side elevational view, partially broken away, showing the erosion resistant sleeve assembly of the blast joint described herein positioned above the tubing connector assembly.
Figure 11:
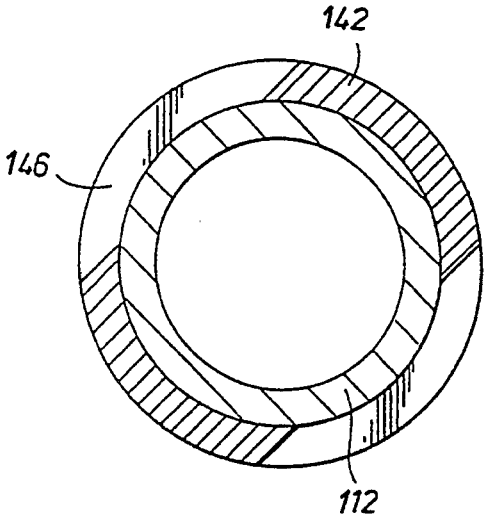
FIG. 11 is a sectional view taken along lines 6—6 of FIG. 8.

Referring to FIGS. 8 and 11, a support sleeve 142 is shown in greater detail. The support sleeve 142 comprises a substantially cylindrical, open ended member. The body of the support sleeve 142 includes a pair of oppositely located slots or apertures 146 permitting access to the tubing 112. The slots 146 are sufficiently large to permit a pipe wrench or the like to engage the tubing 112; however, the structural integrity of the support sleeve 142 is not impaired and the support sleeve 142 will not collapse under the load of the stack of rings 124 supported thereon. The support sleeve 142 includes an upper collar or shoulder portion in abutting engagement with the lowermost carbide ring 130. A circumferential groove 148 is formed about the external upper collar portion of the support sleeve 142 and best shown in FIG. 7B. The groove 148 cooperates with a corresponding groove 172 in a lower cover ring 158 of a sleeve assembly 32 for receiving a retaining wire 152 for maintaining the sleeve assembly 32 in a desired position.

Referring to FIG. 8, the movable protective sleeve assembly 32 of carbide rings 154 is shown in the up or open position. When the blast joint 110 of the present disclosure is out of the well bore, the sleeve assembly 32 is located in the position shown in FIG. 8, above the support sleeve 142. In this manner, access is permitted to the tubing 112 through the slots 146 of the support sleeve 142 so that a pipe wrench may be used for threading the cross-over sub 144 to the pin end of the tubing 112, and subsequently to the box end or coupling connecting the next tubing member extending therebelow. A sleeve 151 encases the carbide rings 154 between an upper cover ring 156 and the lower cover ring 158. The carbide rings 154 have an internal diameter slightly greater than the outer diameter of the carbide rings 124 permitting relative telescoping movement therebetween. The upper and lower cover rings 156 and 158 are welded to the ends of the sleeve 151 at 153 and 155, respectively. The rings 154 are compressed between the cover rings 156 and 158 during assembly of the sleeve assembly 132, ensuring end face to face contact between adjacent rings 154.

Figure 10:
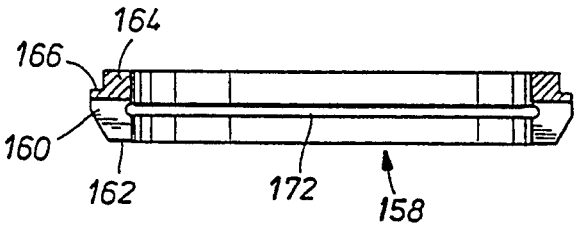
FIG. 10 is a sectional view of the lower cover ring taken along line 5—5 of FIG. 9.
Figure 9:
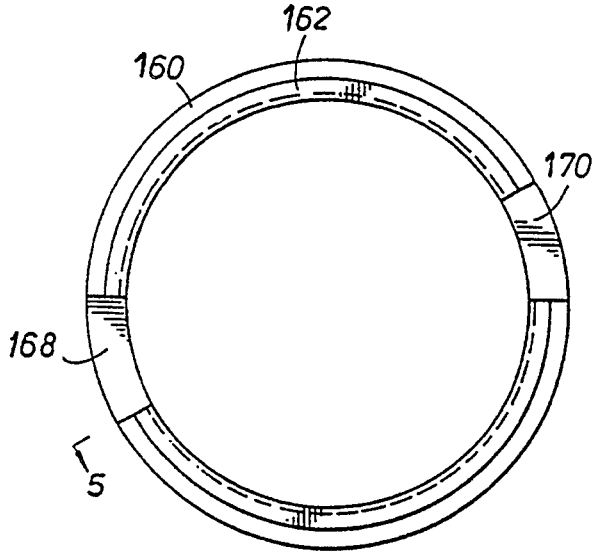
FIG. 9 is a bottom plan view of the lower cover ring with an erosion resistant sleeve of the blast joint.

The lower cover ring 158 is shown in greater detail in FIGS. 9 and 10. The internal diameter of the cover ring 158 is slightly greater than the external diameter of the support sleeve 142 so that it fits snugly about the support sleeve 142 as shown in FIG. 8. The cover ring 158 includes a short tubular body 160 whose outer diameter tapers inwardly at the lower end thereof to a flat planar circumferential surface 162 defining the lower or bottom end of the cover ring 158. The opposite end of the body 160 includes an upstanding cylindrical extension 164 whose outer diameter is slightly less than the inner diameter of the sleeve 151. A circumferential shoulder 166 provides an abutment surface for the sleeve 151 which is retained between the lower cover ring 158 and the upper cover ring 156. The sleeve 151 telescopes about and frictionally engages the extension 164 of the lower cover ring 158 and is welded thereto. Similarly, the opposite end of the sleeve 151 is welded to the upper cover ring 156, thereby completely enclosing the carbide rings 154 and forming a movable assembly of stacked rings 154 slidably along the blast joint 110.

The lower end of the body 160 of the cover ring 158 is slotted at 168 and 170 permitting access to the internal groove 172 formed in the body 160 as best shown in FIG. 9. The internal groove 172 cooperates with the external groove 148 formed on the support sleeve 142 to define a passage therebetween for receiving the retaining wire 152. The slots 168 and 170 permit convenient insertion or removal of the retaining wire 152 for locating the carbide ring assembly along the blast joint 110.

The blast join 110 described thus far comprises the uppermost tubing joint 112 including a cross-over sub 144 threaded on the pin end thereof. In FIG. 7B, a portion of the intermediate tubing joint 113 is shown. The intermediate tubing joint 113 is provided with a conventional buttress or other non-upset threaded coupling 176 for threadable connection to the pin end of the cross-over sub 144. The intermediate tubing joint 113 is enclosed by a series of carbide rings 130 much in the same manner as the tubing joint 112. A spring 178 is disposed about the tubing joint 113 in abutment with a shoulder 180 of the buttress coupling 176. A tungsten carbide guide ring 182 and a plurality of carbide rings 130 are slid about the tubing joint 113 and supported at the lower end thereof by a support sleeve 142 and a cross-over sub 144 in the same manner as described above regarding tubing joint 112. Any desired number of intermediate joints may be serially connected to provide a blast joint 110 of the required length. Each tubing joint is connected by a cross-over sub thereby eliminating flush joint connections and providing a blast joint whose tensile strength equals or exceeds the tensile strength of the complete tubing string.

The lowermost or bottom tubing joint 115, partially shown in FIG. 7C, is substantially identical to the intermediate tubing joint 113. That is, at the upper end thereof, the tubing joint 115 includes a similar buttress or non-upset coupling 176, compression spring 178, and carbide guide ring 182 as shown in FIG. 7B. A series of carbide rings 130 are carried on the bottom tubing joint 115 supported on a lower lock assembly comprising a bowl ring 184 and a slip ring 186 which is substantially identical to the upper lock assembly 126 on the tubing joint 112.

Figure 12:
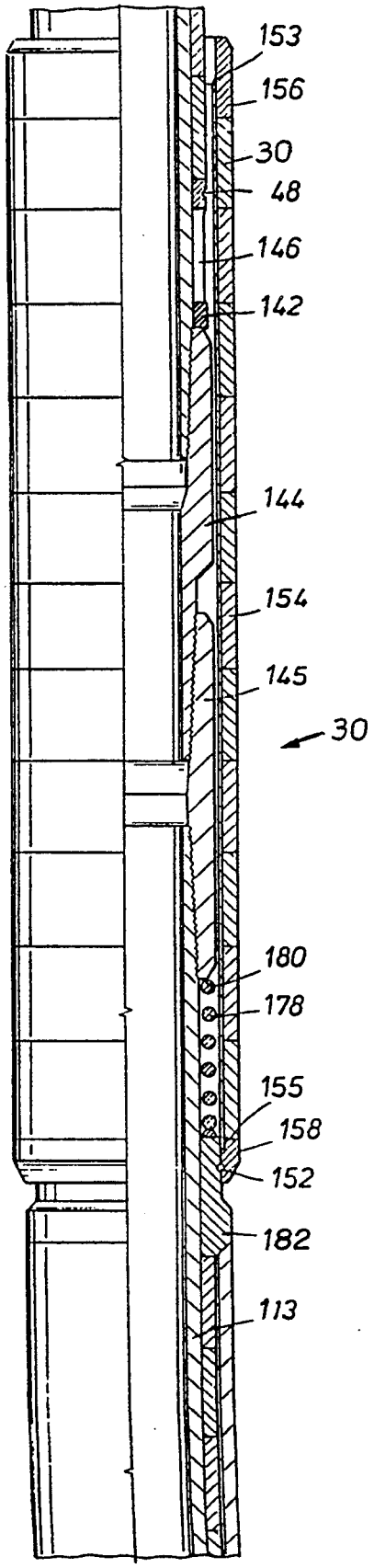
FIG. 12 is a vertical, longitudinal, sectional view of the blast joint described herein showing the erosion resistant coupling shield assembly enclosing the tubing connector assembly.
Figure 13:
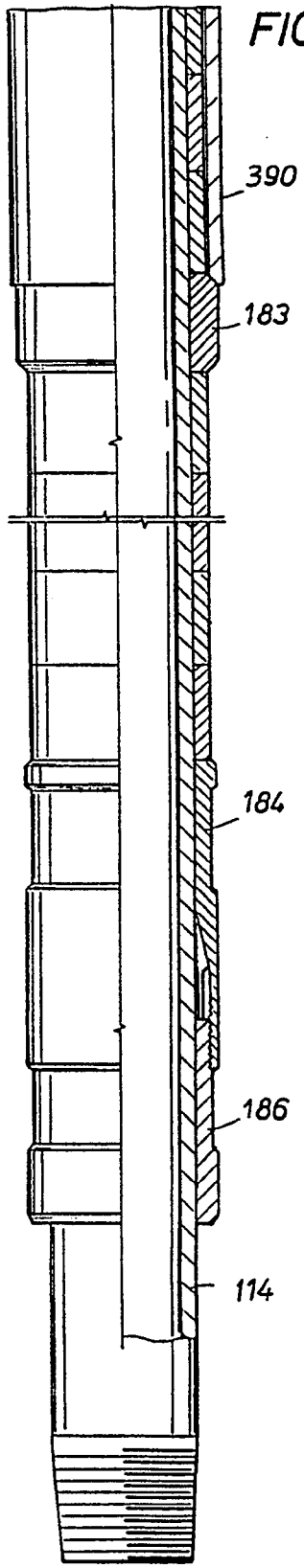
FIG. 13 is a similar vertical, longitudinal, sectional view of the blast joint described herein showing the slip sleeve mounted about the erosion resistant rings on the tubular member.

Referring now to FIGS. 12 and 13, a slip sleeve 390 which can be used with the present invention is shown. The slip sleeve 390 defines a tubular body journaled about the encased tubular member 113. The slip sleeve 390 is approximately eighteen inches to thirty-six inches in length and is retained about the tubular member 113 between the guide ring 182 and a running ring 183. The slip sleeve 390 may be located on the tubular members comprising the blast joint of the invention at any desired location where a gripping surface is required. Typically, the slip sleeve 390 is located below the coupling 145 so that when suspended in the well bore, the slip sleeve 190 presents a surface for engagement by the pipe slips 192 to support the blast joint in the well bore 114 so that the coupling 145 extends above the drill rig floor 392 for connection to the next tubing joint to form the multi-joint blast joint. The slip sleeve 390 is very sturdy and includes sufficient wall thickness so that it does not collapse upon application of lateral compressive force by the pipe slips 392. By an alternative embodiment, the slip sleeve 390 may include serrations formed on its exterior. Blast joints, particularly when formed of several joints, are extremely heavy. This tremendous load must be supported by the pipe slips 392 which grip the slip sleeve 390. The serrations aid in maintaining a secure gripping contact between the slip sleeve 390 and the pipe slips 392.

Figure 14:
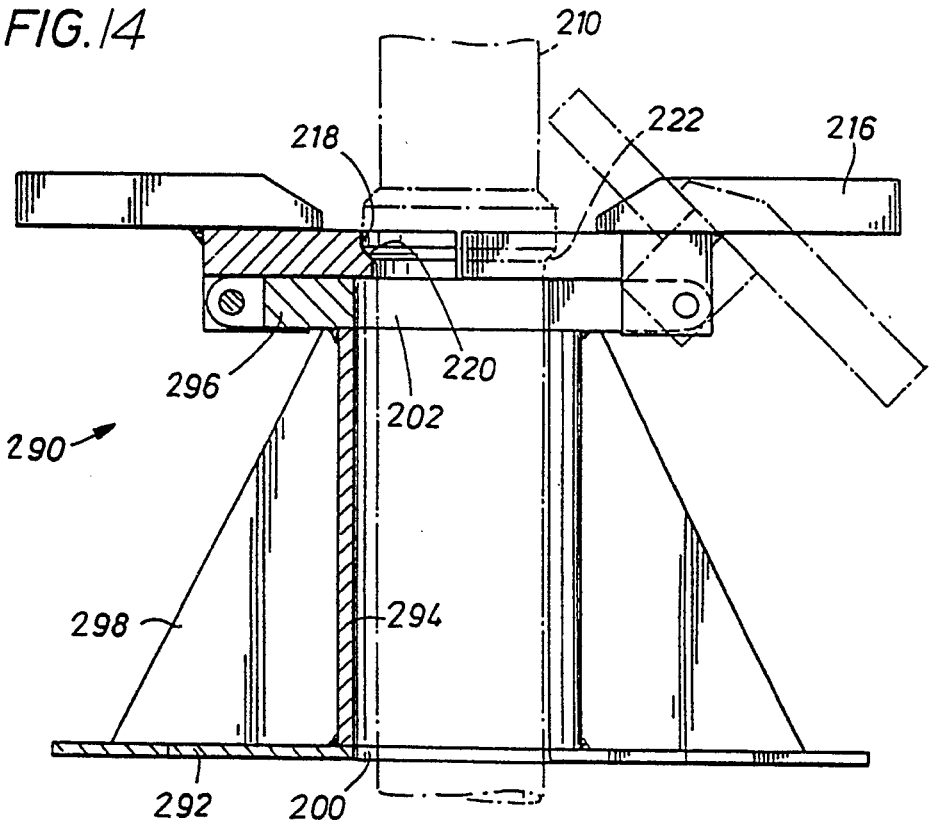
FIG. 14 is a sectional view of the base assembly for supporting a blast joint as described herein for preparatory to lowering in the well bore.
Figure 15:
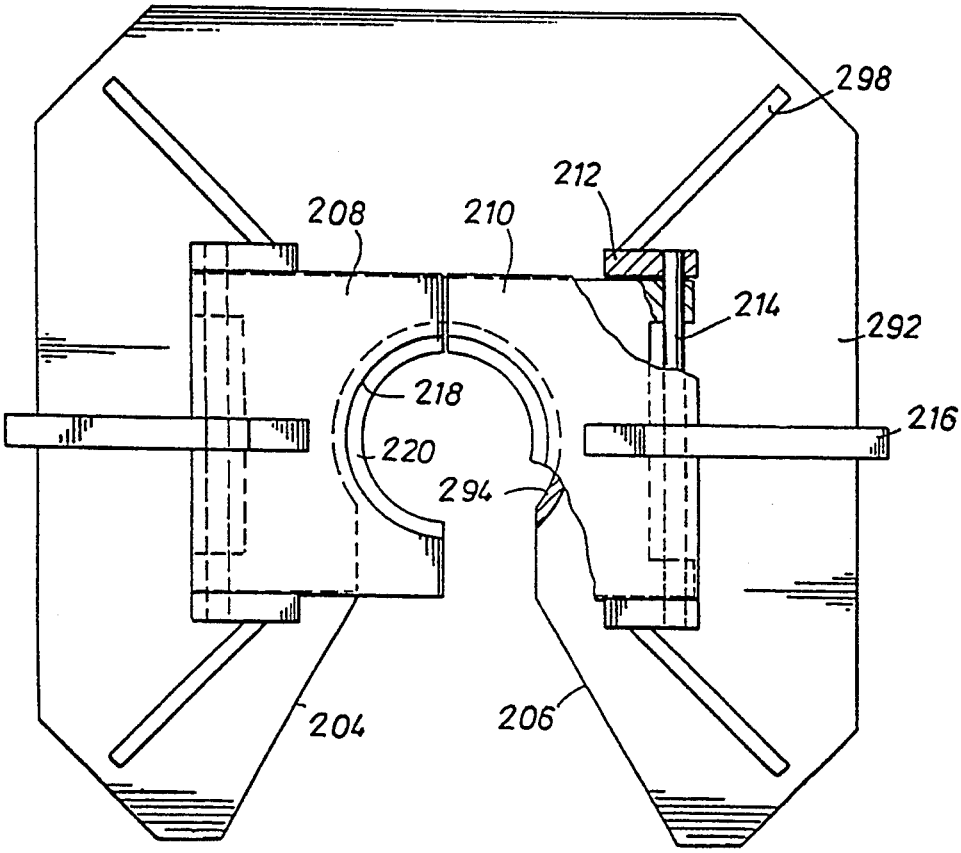
FIG. 15 is a top plan view of the base assembly.

Problems associated with installing blast joints are overcome by using the base assembly 290 shown in FIGS. 14 and 15 during the installation process. The base assembly 290 includes a support base 292. A substantially cylindrical support column 294 extends upwardly from the support base 292 to a cap 296. The support column 294 is braced by a plurality of column braces 298 radially disposed about the support column 294. The column braces 298 extend from the support base 292 to the cap plate 296 forming a rigid radial support structure for the support column 294. The support column 294 is centrally located on the support base 292 and circumscribes a hole 200 formed in the support base 292. The cap plate 296 is substantially rectangular in shape and includes a hole 202 therethrough which is coaxially aligned with the axial passage of the support column 294 and the hole 200. The support column 294 is welded to the support base 292 and the cap plate 296 to form the base assembly 290 as shown in FIG. 14. The base assembly 290 is provided with a lateral slot permitting the blast joint 110 to be laterally received within the support column 294. the lateral slot in the support base 292 is defined by inwardly tapering shoulders 204 and 206 which form a guide for positioning the blast joint 110 in the support column 294.

Supported on the cap plate 296 is a tool support member comprising a pair of tool support plates 208 and 210 supported on the cap plate 296. The tool support plates 208 and 210 are provided with hinge blocks 212 for receiving a pivot rod 214 therethrough. The pivot rod 214 extends through each end of the cap plate 296 and through the hinge blocks 212 permitting the tool support plates 208 and 210 to rotate about the pivot rods 214 toward or away from the cap plate 296. Support handles 216 are provided for manually manipulating the tool support plates 208 and 210.

The tool support plates 208 and 210 are provided with semicircular recess which cooperate to define a tool support opening defined by circumferential wall 218 which terminates at an inwardly tapering shoulder 220. The profile presented by the wall 218 and shoulder 220 substantially matches the profile of the guide ring 282 which includes a tapered shoulder 222 for engagement with the shoulder 220 of the tool support member for suspending the blast joint 110 therefrom.

The base assembly 290 permits the installation of the blast joint 110 without cracking, chipping or otherwise subjecting the carbide rings to high localized compressive stresses. The tubing string 111 is installed in the usual manner. However, when the blast joint 110 is to be installed, the base plate 290 is positioned on the rotary table coaxially aligned with the tubing string 111. The bottom joint 115 of the blast joint 110 is raised from the platform floor and threaded to the tubing string joint suspended from the rotary table. The joint 115 is lowered in the well bore 114 through the base assembly 290. The diameter of the axial passage through the support column 294 is greater than the greatest diameter of the blast joint 110 so that the blast joint passes through the base assembly 290 without contacting the carbide rings 130. The blast joint member 115 and the tubing string 111 therebelow is then suspended from the base assembly 290 upon rotating the tool supports 208 and 210 to the closed positions that the guide ring 282 engages the shoulder 220.

The intermediate blast joint 113 is then raised from the platform floor and the pin end of the cross-over sub 144 is threaded to the coupling 276 of the joint 115 projecting above the base assembly 290. Recall that at this juncture, the carbide ring sleeve assembly 132 is retained above the support sleeve 142 providing adequate room for platform personnel to securely thread the intermediate joint 113 to the joint 115. Upon completion of the connection, the retaining wire 152 is removed and the carbide ring sleeve assembly 132 is lowered to the guide ring 282 and the retaining wire 152 is inserted in the receiving slot defined by the groove 274 on the guide ring 282 and the matching groove 272 on the lower cover ring 258. The intermediate joint 113 is then lifted slightly permitting the tool support plates 208 and 210 to the rotated away from the cap plate 296 so that the intermediate joint 113 may be lowered into the well bore 114. The above process is repeated for each subsequent joint forming the blast joint 110.

Figure 16:
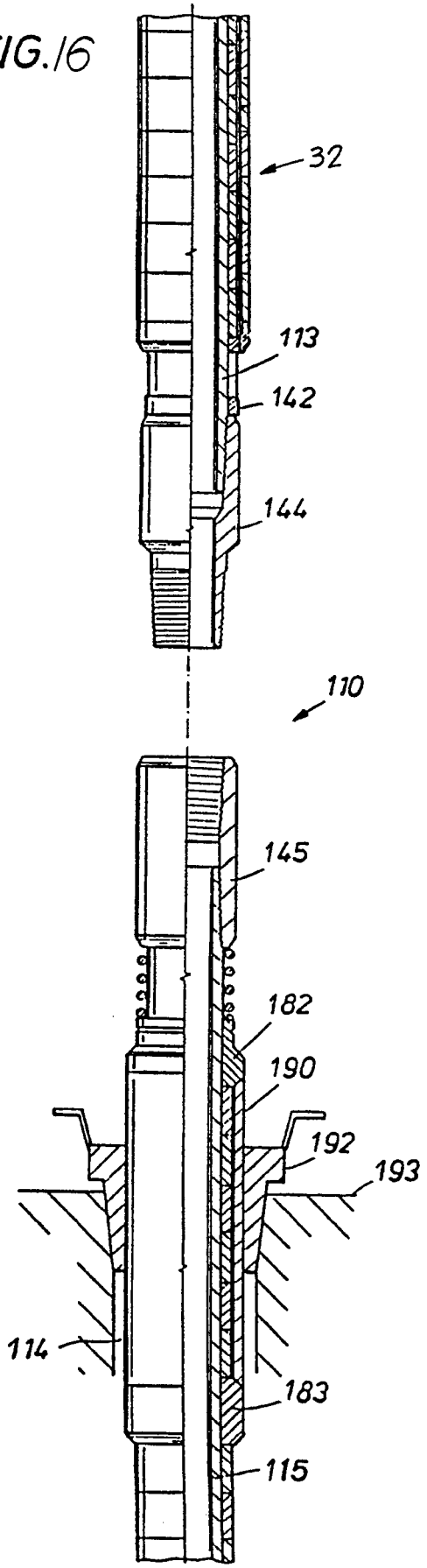
FIGS. 16 and 17 are schematic views showing the installation procedure of the multi-joint blast joint described herein utilizing a slip sleeve.
Figure 17:
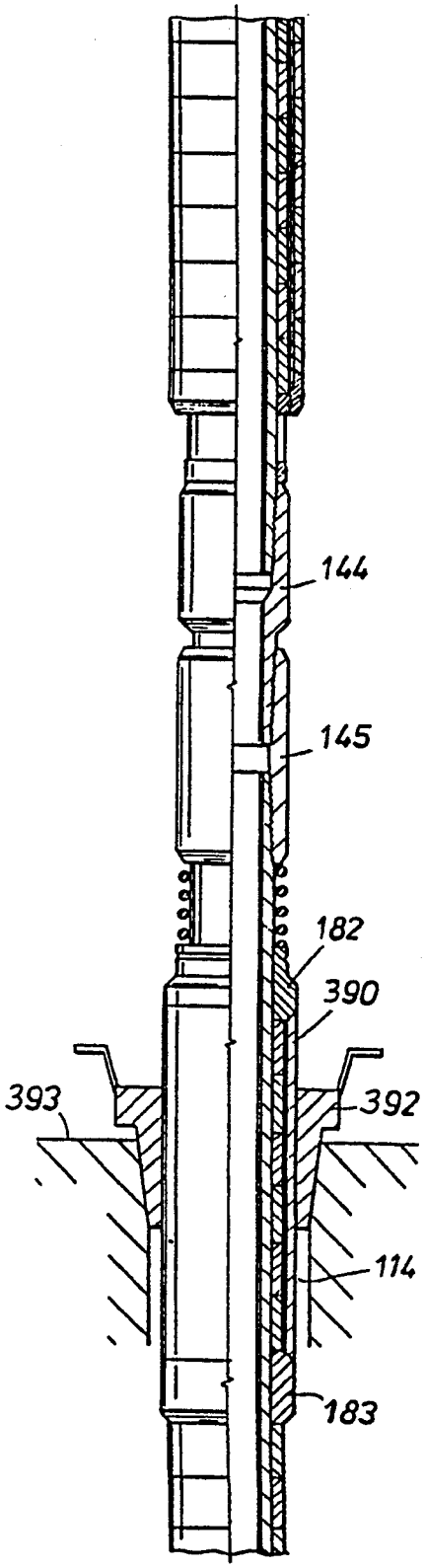

Referring to FIGS. 16 and 17, the installation procedure of a blast joint utilizing a slip sleeve is schematically shown. It will be observed that the lowermost joint 115 forming the blast joint 110 is supported in the well bore 114 by the pipe slips 392 which engage the slip sleeve 390 and are supported by the drill rig floor 393 as shown. The upper end of the tubing joint 115 projects above the drill rig floor 393. The pipe coupling 145 is exposed and may be gripped by the power tongs for making up the connection with the next joint forming the blast joint 110. The intermediate tubing joint is suspended above the drill rig floor 393 in the customary fashion for connection to the tubing joint 112 supported in the well bore 114. In this regard, rig personnel make the connection in the usual manner using the customary rig equipment for making a connection between two joints. That is, power tongs are typically used to engage the cross-over sub 144 and couplings 145 to make the connection.

In FIG. 17, the connection between the two joints has been completed. Prior to removing the pipe slips 392, the coupling shield 32 is lowered about the cross-over sub 144 and coupling 145. The coupling shield 32 is locked to the guide ring 182 in the manner described above to provide a protective shield about the cross-over sub 144 and coupling 145. Once the coupling shield 32 is locked in position, the blast joint string is lifted slightly and the pipe slips 392 are removed. The blast joint string is then lowered into the well bore 114 and supported therein again by engagement of the pipe slips 392 about the slip sleeve journaled about the blast joint tubing 113.

The use of the centralizer 2 of the present invention with these blast joint designs is accomplished by placing an oversized ring 38 at the point immediately below the preferred location of the centralizer. The first oversize ring 38 can be placed either abutting other carbide rings 30 or at the lower most end of a blast joint assembly immediately above the lower locking assembly. Once the first oversize ring 38 is placed on the blast joint, a sufficient number of standard blast joint rings 30 will then be placed in direct abutment to the first oversized ring which will allow for the continued enclosure of the tubing 34. The number of rings 30 should be sufficient to surround same area of the production tubing 34 that will be surrounded by the centralizer 2. The centralizer is then placed over these rings and a second oversized ring 38 is placed in direct abutment to the rings 30 which are located within the circumference of the centralizer 2. Additional rings 30 can be placed about the tubing for any extended length desired.

When the present invention is utilized either in a blast joint configuration or alone, it maintains the production tubing in a generally central location in relation to the casing production tubing 34 and 36 in a generally central location with respect to the casing 40. Once the tubing has been run downhole, it normally will remain in the same general position for a significant period of time, possibly years. On occasion, a buildup of undesirable settlement, including sand, dirt or the like, can accumulate around the blast joint or tubing and possibly the centralizer. When this occurs, the buildup can become so great that the tubing cannot be moved from its present location.

When this occurs and the tubing needs to be moved for purposes of making adjustments or alterations with the well or reworking the well when the tubing is completely removed, the sediment must be removed in order to allow freedom of movement before the tubing. This is normally accomplished with what is known as a wash pipe. As in FIG. 5, a wash pipe 51 or rotary shoe generally surrounds the production tubing and any blast joints utilized thereon to remove any buildup of sediment or the like. Obviously, once the wash pipe or shoe comes in contact with the centralizer, the design of the present invention allows for the segmented portions 18 of the stress risers 12 extending outwardly from the centralizer 2 to be sheared off to such an extent so as to allow the wash pipe to continue down the circumference of the production tubing 34. The wash pipe can then be run to any desired length downhole to remove any sediment buildup and removed to allow for adjustment or removal of the production tubing and/or blast joint altogether.

While the present invention, both apparatus and method, have been described with specific embodiments thereof, in light of the foregoing description, it is evident that many alternatives, modifications and variations will be apparent to those skilled in the art. Accordingly, this patent is intended to embrace all such alternatives, modifications and variations as falls in the spirit of the invention and scope of the appended claims.

What is claimed:

1. A centralizer for use in a well bore comprising:

(a) a cylindrical body;

(b) a plurality of segmented stress risers extending outwardly from said body; and, (c) means for allowing at least some portions of said stress risers to be separated from the remaining portion and said body while in said well bore.

2. The centralizer of claim 1 wherein said stress risers further comprise a plurality of apertures spaced intermittently along the length and through said risers.

3. The centralizer of claim 1 wherein said stress risers further comprise a plurality of channels extending perpendicularly from the outer surface of said cylindrical body and through said stress risers.

4. The centralizer of claim 2 further comprising a plurality of channels in said stress risers extending perpendicularly outward from the outermost point relative to said cylindrical body of said apertures.

5. A blast joint centralizer to be used in a well bore comprising:

(a) a cylindrical body; and, (b) a plurality of segmented stress risers extending outwardly from said body.

6. The centralizer of claim 5 further comprising a means for allowing at least some portions of said stress risers to be separated from the remaining portion in said body while in said well bore.

7. The centralizer of claim 5 wherein said stress risers further comprise a plurality of apertures spaced intermittently along the length and through said risers.

8. The centralizer of claim 5 wherein said stress risers further comprise a plurality of channels extending perpendicularly from the outer surface of said cylindrical body and through said stress risers.

9. The centralizer of claim 5 further comprising a plurality of channels in said stress risers extending perpendicularly outward from the outermost point relative to said cylindrical body of said apertures.

* * * * *